United States Patent [19]

Milne

[11] Patent Number: 4,849,286

[45] Date of Patent: Jul. 18, 1989

[54] TRANSPARENT PLOTTER FILM

[75] Inventor: Marjorie H. Milne, Holyoke, Mass.

[73] Assignee: James River Graphics, Inc., South Hadley, Mass.

[21] Appl. No.: 132,033

[22] Filed: Dec. 14, 1987

[51] Int. Cl.[4] ..... B41M 5/00

[52] U.S. Cl. ..... 428/336; 428/195; 428/207; 428/331; 428/423.1; 428/423.7; 428/480; 428/483; 428/500; 428/914

[58] Field of Search ..... 428/195, 207, 423.1, 428/423.7, 480, 483, 331, 914, 336, 500

[56] References Cited

U.S. PATENT DOCUMENTS 4,578,285 3/1986 Viola ..... 428/480

4,686,118 8/1987 Arai et al. ..... 428/480

*Primary Examiner*—Ellis P. Robinson

*Assistant Examiner*—P. R. Schwartz

*Attorney, Agent, or Firm*—Burns, Doane, Swecker & Mathis

[57] ABSTRACT

There is provided a transparency sheet suitable for plotter recording having a coating comprised of a polyurethane and a highly hydrophilic polymer. The hydrophilic polymer is preferably polyvinylpryolidone which is admixed with a "water borne" polyurethane.

12 Claims, No Drawings

TRANSPARENT PLOTTER FILM

BACKGROUND OF THE INVENTION

1. Field of the Invention

This invention relates to graphic plotter recording media. Particularly, this invention relates to transparent plotter sheet material.

2. Description of the Prior Art

Polymeric sheet materials have been extensively used as image receiving surfaces for use with overhead projectors or the like. However, a continuing problem with the use of polymeric transparencies has been the generally hydrophobic nature of these materials. Associated with the surface characteristics of the film are numerous problems including, for example, ink repulsion (e.g., hydrophobic films will cause hydrophilic inks to bead up on the surface rather than be absorbed) and low ink dry times for those that do absorb, smudging, color intensity, ink spreading etc.

An important use for polymeric transparency recording media substrates is with computer driven graphic pen plotters. These plotters use pens which trace across the recording medium surface. In multi-color plotters often numerous pen types are used. The pen types are purchased with the plotters or separately for special applications. Many of such pens are hard pointed which require a plotter substrate with integrity to avoid tearing, pen clogging and related problems. Generally, all the pens typically require low volatility inks to maintain the ink flow, in that the plotters work in an open environment. Low volatility inks exaggerate the problems of sorption and poor drying. Suggested solutions, such as coating silica on transparencies, increase sorption of inks but are abrasive and decrease normal pen life.

One proposed solution to the above problem involves coating the polymeric films with absorbent particles such as silica, coupled with employing a separate oil-based or hydrophobic ink with the particle coated transparency. However, in normal operations, pen plotters and like recorders utilize hydrophilic inks and ink pens. Consequentially, using coated transparent films which are designed to absorb hydrophobic inks require a troublesome pen and ink switchover. Obviously, it would be desirable in terms of efficiency, cost, and marketability if transparencies could be recorded by the same pen and ink arrangements used for opaque, e.g., paper, substrates.

A proposed solution to these problems is in U.S. Pat. No. 4,301,195, which discloses a polyester transparent sheet coated with two polymers, which are either used together in a single layer or separately as two layers. The first polymer is described as an epoxidized diene-containing material (e.g., cis-1,4-polybutadiene rubber epoxidized then aminized with a secondary monoamine such as dimethyl amine) and a polyvinyl alcohol-polyvinyl acetate resin (PVA). In the two layer construction the PVA is the upper or surface layer. A related U.S. Pat. No. 4,379,804, proposes a two layer system with a liquid permeable layer overlying a liquid sorbent layer. Exemplary liquid sorbent underlayers include polyvinyl acetate and gelatin, among others, and exemplary liquid permeable upper layers comprise cellulose acetate/butyrate or gelatin (of a different molecular weight), among others. Although these sheets allegedly have dry times less than 3 seconds, the search goes on for transparent sheets with greater color intensity, less abrasiveness, greater ink permeability, improved dry times, improved smudging resistance, lower costs, among other properties.

It is a general object of the present invention to provide a transparent film to solve or substantially alleviate the above noted problems in the art.

It is a more specific object of the present invention to provide a transparent film that is receptive to hydrophilic inks while maintaining sufficient surface integrity to be used with, e.g., plotter pens.

It is another object of the present invention to provide a transparent film which is relatively non-abrasive, thereby improving pen life.

It is another object of the invention to provide a coated pen plotter transparency that is easily produced and is absorbent to hydrophilic inks to produce sharp images with low-dry times and generally improved imaging properties.

These and other objects, as well as the scope, nature and utilization of the invention, will be apparent to those skilled in the art from the following description, and the appended claims.

SUMMARY OF THE INVENTION

A transparent sheet is provided which is receptive to low viscosity ink comprising a transparent substrate and an ink receptive layer thereon comprising 40 to 65 weight percent polyurethane and 35 to 60 weight percent of a hydrophilic polymer.

DESCRIPTION OF THE INVENTION

According to the present invention a composite media is prepared by coating a substrate with a water based polyurethane composition containing added amounts of a suitable water soluble hydrophilic polymer, and optionally, added amounts of wetting agents, surfactants, blocking agents and other suitable additives.

The substrate can be any conventional material used in the manufacture of transparencies such as, polyesters, polymethacrylic acids and methyl or ethyl esters, polyamides, polyolefins, polystyrenes, polycarbonates, polymeric films formed from ethylene glycol terephthalic acid, or suitable transparent papers, etc. These sheets often need pretreatment to promote adhesion. For example, polyolefins such as polypropylene, have low surface energies and generally require an adhesive sublayer or surface treatments as are known in the art to improve adhesion. Conventional surface treatments include chemical oxidation, radiation treatment and corona discharge treatments. Suitable sublayers, include vinylidene chloride, gelatin, and quaternary ammonium group containing polymers.

Particularly preferred transparent films are polyethylene terephthalate films, and to a lesser extent other polyesters. These films are generally from about 0.025 to about 0.26 millimeters thick.

The present invention film is directed toward a coated transparent film which will provide suitable ink absorbency and drying times while giving a sharp image with high brilliance and resolution when used with a pen plotter or like recording means.

The present invention is based on the discovery that for a transparent film used in a pen plotter, the use of a coating film comprised of from about 40 to about 65 weight percent of a polyurethane with from about 35 to about 60 weight percent of a highly hydrophilic polymer provides a transparent medium with superior properties as a pen plotter recording medium. This transparent medium allows the use of conventional water-based inks, without the necessity of resorting to a separate set of oil based inks and pens, thereby allowing the printing advantages of low viscosity inks while simultaneously providing an image which is both clear and brilliant.

The polyurethanes employed can be selected from a wide range of conventional polyurethanes such as, for example, polyalkylene ether glycol alkylene diisocyanates such as polyethylene glycol ethylene diisocyanate or polyalkylene oxide alkylene diisocyanates, or polymers such as polytetramethylene ether glycol diphenylmethane diisocyanate, polytetramethylene ether glycol-isoferrone isocyanate, poly(1, 3-oxybutylene) glycol-diphenyl diisocyanate, poly(1, 4-oxybutylene) glycol-toluene diisocyanate, poly(1, 4-oxybutylene) glycol-tolisoferrone isocyanate, polypropylene-glycol-toluene diisocyanate, polypropylene glycolisoferrone isocyanate, polycaprolactonetoluene diisocyanate, polycaprolactone-isoferrone isocyanate, polyethylene adipate-toluene diisocyanate, polyethylene adipateisoferrone isocyanate, polytetramethylene adipate diphenylmethane diisocyanate, polytetramethylene adipate-toluene diisocyanate, polytetramethylene adipate-isoferrone isocyanate, polytetrapropylene adipate-diphenylmethane diisocyanate, polyethylene-propylene adipate-toluene diisocyanate, and polyethylene-propylene adipate-isoferrone isocyanate polyurethanes.

Between aliphatic and aromatic polyurethanes, generally, the aliphatic polyurethanes are preferred for transparency reasons. "Aliphatic" refers to the backbone of the polymeric chain, i.e., the diol or isocyanate formed segments. These aliphatic polymers include those formed from polyols such as polyethylene oxide, butane diols, ethylene glycols, etc. and suitable aliphatic isocyanates such as ethylene diisocyanates, ethylidene diisocyantes, propylene diisocyanates, butylene diisocyanates and cyclohexylene diisocyanates. These polyurethanes are formed by any suitable solvent polycondensation reaction or melt condensation reaction.

Particularly preferred polyurethanes found suitable for the instant invention are the so-called "water-borne" polyurethanes. These polyurethanes are so titled as a major solvent component of the solution is water, although suitable organic solvents such as N-methylpyrrolidone are also present. These polymers are suitable for admixture with the highly hydrophilic water soluble polymer. However, it is within the contemplation of the invention to use organic solvent based polyurethane solutions so long as the organic solvent is sufficiently miscible with water to allow intimate admixture with the water soluble polymer. Also possible is the use of a diluent which is both miscible with aqueous solvents and more hydrophobic organic solvents so as to allow formation of a single liquid phase.

The highly hydrophilic water-soluble polymer can include, for example, polyvinylpyrrolidone, polyethylene oxide, gelatin, polyacrylics, poly (methyl vinyl ether) mono methyl maleate, cationic starch, quaternary ammonium type polymers, polyvinylpyrrolidone-vinyl acetate copolymer, etc., of these polyvinylpyrrolidone and polyvinylpyrrolidone-vinyl acetate copolymer are preferred due to their high hydrophilic properties and hardness. The molecular weights of these polymers generally range from about 10,000 to about 700,000. Specifically, for polyvinylpyrrolidone the preferred molecular weight ranges from 30,000 to 700,000, and more preferably from 360,000 to 700,000.

The hardness of the polyurethane film with the hydrophilic polymer can be controlled by the addition of suitable additives such as plasticizers like dimethyl phthalate, glycerine, diethylene glycol, sorbitol, allylsulfonamideformaldehyde, cellulose butyrate or cellulose butyratepropionate. With such additives the surface hardness characteristics of the film can be altered to an appropriate level. For example, if the film is too soft, the pen will tend to gouge the film surface and possibly clog. Conversely, if the film is too hard, its sorption properties could suffer.

Additional additives which can be incorporated into the film are conventional surfactants, (e.g. up to 2% by weight) such as nonionic surfactants represented by polyethylene glycol, and ionic surfactants represented by a cationic fluorosurfactant such as ZONYL-FSC. Surfactants alter the surface characteristics and wettability of the film. The nonionic surfactant polyethylene glycol is a particularly preferred additive for its ability to improve flowout and is used up to a weight percent of about 2%.

Other additives that may find suitable use in the claimed composition include U.V. absorbers and preservatives, as well as other conventional coating additives.

The film can also include additive amounts of antiblocking agents such as a silica (generally less than 30 micron particle size), glass beads or polytetrafluoroethylene particles. These materials may be included in an amount up to 0.4% by weight of the coating solids and provide antiblocking properties without significantly affecting sheet transparency.

The coating can be applied by any method which is known in the art such as roller coating, air knife coating, doctor blade coating, Mayer bar coating, spray coating and gravure. The coating thickness is 5 to 15 microns, preferably 6 to 12 microns, and most preferably 7 to 8 microns. The applied polymeric coating mixture is then generally dried at 270° to 275° F. for 2½ to 3 minutes.

The polyurethane is used in an amount such that it accounts for about 40 to 65% by weight solids of the coating solids composition, preferably 40 to 45% by weight solids.

When used in a water borne polyurethane, the polyurethane is generally 29 to 37 weight percent of the water born admixture solution with the aqueous solvent accounting for 53 to 61 weight percent, and any organic solvent accounting for 9 to 17 weight percent of the solvent.

The hydrophilic polymer generally accounts for 40 to 65 weight percent of the coating solids percentages. With the preferred hydrophilic polymer polyvinyl pyrrolidones, the weight percent is generally 35 to 60 solids weight percent, preferably 55 to 60 weight percent and most preferably 57 to 60 weight percent, with up to 2 percent polyethylene glycol being used in a most preferred embodiment. Solvents, preferably mainly water, are used in an amount such as to provide a solids admixture with a consistency suitable for the particular application technique. With Mayer bar coating, this amounts to 70 to 75 parts (by weight) solvent per 100 parts of solids (See Table IV).

EXAMPLE 1

In this example, water soluble polyvinyl pyrrolidone (P.V.P) was added to a polyurethane resin dispersion (NeoRez R-960) (33% solids) with additional added amounts of polyethylene glycol and a surfactant in the proportions of Table 1.

TABLE 1

| | |
|---|---|
| NeoRez 960 (33%) | 20.0 gms |
| P.V.P. (K90) | 5.0 gms |
| P.E.G. (400) | 0.18 gms |
| Zonyl FSC (50%) | 0.02 gms |
| Water | 74.80 gms. |

This composition was then handcoated onto a 7 mil prebonded base with a No. 24 Mayer Rod.

The coating produced has a dry thickness of 0.32 mils. The coating was dried for 2½ minutes at 300° F. The dried hand coated film was evaluated for its performance on a Hewlett Packard plotter Model 7470A using 0.3 mm Hewlett Packard T3 pens. The composition displayed the qualities of no pen clogging, no bleeding, and a black density 81 percent of that required, i.e., 1.44 to 1.55 on the McBeth TR-524 Densitometer-yellow filter (visual).

EXAMPLE 2–11

The composition component concentrations of Example 1 were varied to have the relative proportions displayed in Table II.

TABLE II

| | 100 gram mixes (approximate) | | | | |
|---|---|---|---|---|---|
| | NeoRez R-960 | Peg 400 | PVP.K90 | $H_2O$ | FSC |
| 1 | 20.00 | 0.18 | 5.00 | 74.80 | 0.02 |
| 2 | 16.36 | 2.4 | 4.20 | 77.04 | 0.02 |
| 3 | 16.36 | 1.32 | 5.28 | 77.04 | 0.02 |
| 4 | 16.38 | .24 | 6.36 | 77.04 | 0.02 |
| 5 | 19.64 | .24 | 5.28 | 74.81 | 0.02 |
| 6 | 22.91 | .24 | 4.20 | 72.65 | 0.02 |
| 7 | 19.64 | 1.32 | 4.20 | 74.84 | 0.02 |
| 8 | 18.55 | 0.96 | 4.92 | 75.51 | 0.02 |
| 9 | 20.64 | — | 6.28 | 73.08 | 0.02 |
| 10 | 18.64 | — | 8.28 | 73.08 | 0.02 |
| 11 | 16.64 | — | 10.28 | 73.08 | 0.02 |

The compositions of Table II were applied with a No. 20 Mayer Rod and coated onto a 7 mil pre-bonded base. The coated base was dried for 2½ minutes at 275° F.

TABLE III

| | Polyurethane | PEG 400 | PVP | Quality |
|---|---|---|---|---|
| 1 | 56.0 | 1.6 | 42.4 | y |
| 2 | 45.0 | 20 | 35 | p |
| 3 | 45.0 | 11 | 44 | p |
| 4 | 45.0 | 2 | 53 | p |
| 5 | 54.0 | 2 | 44 | y |
| 6 | 63.0 | 2 | 35 | x |
| 7 | 54.0 | 11 | 35 | p |
| 8 | 51.0 | 8 | 41 | p |
| 9 | 52.0 | — | 48 | w |
| 10 | 42.6 | — | 57.4 | x |
| 11 | 34.8 | — | 65.2 | w |

x - good, y - excellent, w - poor, p - precipitated.

Table III indicates the solids percentage of the mixes from Table II and also indicates the general quality of the film, i.e., flowout density, drying speed, brightness of colors, etc. The best results were obtained when the polyurethane concentration ranged from approximately 40 to 65 percent with a lower percentage of PEG of 2% or less and 35 to 60 percent polyvinyl pyrrolidone.

EXAMPLE 13

This example composition was a variation of the composition of Example 10 containing additional quantities of blocking agent OK-412 (a silica) and polyethylene glycol in the amounts set forth in Table IV.

TABLE IV

| | Parts | Solids | % of Solids |
|---|---|---|---|
| Water | 73 | — | — |
| PVP (K90) | 8.825 | 8.825 | 58.68 |
| NeoRez (R-960) | 18.64 | 6.15 | 40.89 |
| P.E.G. (400) | 0.04 | 0.04 | 0.266 |
| Zonyl FSC | 0.02 | 0.01 | 0.066 |
| OK 412 | 0.015 | 0.015 | 0.100 |
| | 100.00 gms | 15.04 gms | 100.002 |

This coating admixture provided an excellent coating with good density, rapid drying, bright colors, and good flowout.

The above examples are presented for illustration purposes only. Other embodiments will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A transparent sheet receptive to low viscosity inks comprising a transparent substrate and an ink receptive layer thereon comprising from about 40 to 65 weight percent polyurethane and from about 35 to 60 weight percent of a hydrophilic polymer.

2. The transparent sheet of claim 1, Wherein the polyurethane is a water-borne polyurethane.

3. The transparent sheet of claim 2, wherein the high hydrophilic polymer is polyvinylpyrrolidone.

4. The transparent sheet of claim 3, further comprising at least one surfactant.

5. The transparent sheet of claim 3, further comprising less than 2 weight percent polyethylene glycol.

6. The transparent sheet of claim 3, further comprising an anti-blocking agent.

7. The transparent sheet of claim 6, wherein the anti-blocking agent is silica.

8. The transparent sheet of claim 7, wherein the ink receptive layer is 7 to 8 microns thick.

9. The transparent sheet of claim 1, wherein the transparent substrate is polyethylene terephthalate.

10. A transparent plotter film comprising a transparent support and an ink receptive layer comprising 40 to 65% by weight of polyurethane, 35 to 60% by weight of polyvinylpyrrolidone, 0 to 2% by weight polyethylene glycol, and 0 to 0.4% by weight of a silica.

11. The transparent substrate of claim 10, further comprising a cationic fluorosurfactant.

12. The transparent substrate of claim 10, further comprising a cationic fluorosurfactant wherein the support is polyethylene terephthalate.

* * * * *